US009751332B2

(12) United States Patent
Zhang et al.

(10) Patent No.: US 9,751,332 B2
(45) Date of Patent: Sep. 5, 2017

(54) METHOD FOR APPLYING AND EXPOSING COATING OR INK COMPOSITIONS ON SUBSTRATES TO RADIATION AND THE PRODUCT THEREOF

(75) Inventors: Yuemei Zhang, Ramsey, NJ (US); Prasad K. Adhikari, Carlstadt, NJ (US)

(73) Assignee: SUN CHEMICAL CORPORATION, Parsippany, NJ (US)

( * ) Notice: Subject to any disclaimer, the term of this patent is extended or adjusted under 35 U.S.C. 154(b) by 235 days.

(21) Appl. No.: 13/993,858

(22) PCT Filed: Dec. 13, 2011

(86) PCT No.: PCT/US2011/064547

§ 371 (c)(1),
(2), (4) Date: Sep. 16, 2013

(87) PCT Pub. No.: WO2012/082687

PCT Pub. Date: Jun. 21, 2012

(65) Prior Publication Data

US 2014/0002562 A1 Jan. 2, 2014

Related U.S. Application Data

(60) Provisional application No. 61/422,279, filed on Dec. 13, 2010.

(51) Int. Cl.
*B41J 11/00* (2006.01)
*B05D 3/02* (2006.01)
(Continued)

(52) U.S. Cl.
CPC ..... *B41J 11/002* (2013.01); *B05D 3/0209* (2013.01); *B05D 3/067* (2013.01); *B05D 3/068* (2013.01);
(Continued)

(58) Field of Classification Search
CPC .... B41J 11/002; B41M 7/009; B41M 7/0081; B05D 3/0209; B05D 3/067; B05D 3/068;
(Continued)

(56) References Cited

U.S. PATENT DOCUMENTS 4,435,461 A 3/1984 Gray, III et al.
6,485,600 B2 11/2002 Neuhaus-Steinmetz et al.
(Continued)

FOREIGN PATENT DOCUMENTS

CN 101283061 10/2008
EP 0106695 A1 4/1984
(Continued)

OTHER PUBLICATIONS

Chinese Office Action for Application No. 201180067310.X dated Jan. 6, 2015, with English translation.
(Continued)

*Primary Examiner* — Henok Legesse
(74) *Attorney, Agent, or Firm* — Charles C. Achkar; Ostroelnk Faber LLP

(57) ABSTRACT

The present invention describes a two-sided radiation exposure method including a step of applying a coating or ink composition on a surface of a nonporous substrate. The applied coating or ink composition surface of the nonporous substrate is exposed to radiation one or more times. In addition, a non-applied surface of the nonporous substrate is exposed to radiation one or more times. The two-sided radiation exposure method improves adhesion and/or curing properties of the coating or ink composition applied on the nonporous substrate. The present invention also describes a radiation exposed, nonporous substrate with a coating or ink composition applied on a surface thereof produced by the steps of the above-mentioned method.

25 Claims, 7 Drawing Sheets

(51) Int. Cl.

| | |
|---|---|
| ***B05D 3/06*** | (2006.01) |
| ***B41M 7/00*** | (2006.01) |
| *B05D 5/10* | (2006.01) |

(52) U.S. Cl.
CPC ..... *B41M 7/009* (2013.01); *B41M 7/0081* (2013.01); *B05D 5/10* (2013.01); *B05D 2201/02* (2013.01); *B05D 2202/00* (2013.01)

(58) Field of Classification Search
CPC ... B05D 5/10; B05D 2201/02; B05D 2202/00
USPC ..... 347/104
See application file for complete search history.

(56) References Cited

U.S. PATENT DOCUMENTS

| | | | | |
|---|---|---|---|---|
| 2009/0163615 | A1 | 6/2009 | Halahmi et al. | |
| 2010/0015353 | A1 | 1/2010 | Altman et al. | |
| 2010/0331478 | A1* | 12/2010 | Claes ..... | C09D 11/101 524/560 |

FOREIGN PATENT DOCUMENTS

| | | | | |
|---|---|---|---|---|
| EP | 0994167 | A2 | 4/2000 | |
| EP | 1321268 | A2 | 6/2003 | |
| JP | 2001-205179 | A | 7/2001 | |
| JP | 2003-535721 | A | 12/2003 | |
| JP | 2006-181430 | A | 7/2006 | |
| JP | 2006181430 | * | 7/2006 | ..... B05C 9/12 |
| JP | 2007-519771 | A | 7/2007 | |
| JP | 2007-262281 | A | 10/2007 | |
| JP | 2010-006887 | A | 1/2010 | |

OTHER PUBLICATIONS

Chinese Office Action for Application No. 201180067310.X dated Apr. 28, 2014, with English Translation.
International Search Report Application No. PCT/US2011/064547, dated Apr. 5, 2012.
Indonesian Office Action issued in Indonesian Application No. W00201303210 dated Feb. 15, 2016 (with English Language Translation).
Chinese Office Action issued in Chinese Application No. 201180067310.X dated Dec. 15, 2015 (with English Language Translation).
Japanese Office Action issued in Japanese Application No. 2013-544673, dated May 30, 2016 (with English Language Translation).
Australian Office Action issued in Australian Application No. 2011-343999, dated Apr. 13, 2016.
Author Unknown, "Offset Printing on Nonabsorptive Surfaces," downloaded from http://www.printing.org/page9724, date accessed: Sep. 30, 2016, pp. 1-3.
Finson., Eric and Kaplan, Stephen L., "Surface Treatment," downloaded from http://www.plasmatechsystems.com/about/pubs/surfacetreatment.asp, date accessed: Sep. 29, 2016, pp. 1-9.
Smith, Russell E., "Surface Treatment Discussion," downloaded from https://www.accudynetest.com/surface_treatmetn.html , date accessed: Sep. 29, 2016, pp. 1-9.
The Printing Ink Manual, Fifth Edition, (2007). Kenee, J.E. and O'Flynn P. Dry offset inks, *Pretreatment of substrate*, (p. 456) Dordrecht, The Netherlands, Springer.
Cushing, Ginger, "Chemical Primers as Surface Modifiers for Film Substrates," downloaded from https://www.pstc.org/files/public/Cushing.pdf, date accessed: Sep. 29, 2016, pp. 1-6.
Japanese Office Action for Application No. 2013-544673 dated Jul. 6, 2015, with English translation.

* cited by examiner

METHOD FOR APPLYING AND EXPOSING COATING OR INK COMPOSITIONS ON SUBSTRATES TO RADIATION AND THE PRODUCT THEREOF

CROSS REFERENCE TO RELATED APPLICATIONS

This application is the United States national phase filing of the corresponding international application number PCT/US2011/064547, filed on Dec. 13, 2011, which claims priority to and benefit of U.S. Provisional Application No. 61/422,279, filed on Dec. 13, 2010, which applications are hereby incorporated by reference in their entirety.

FIELD OF THE INVENTION

Generally, the present invention is directed to a method for applying energy curable coating or ink compositions onto a substrate followed by two-sided exposure of the composition to improve adhesion characteristics. This invention also is directed to a novel, cured product produced by the two-sided radiation exposure method.

BACKGROUND OF THE INVENTION

Ink or coating compositions applied on transparent or semi-transparent substrates conventionally are exposed to radiation curing only from one surface of the substrate. Generally, the surface with the composition applied thereon directly is exposed to radiation. One-sided radiation exposure affects the extent of polymerization.

Non-uniform polymerization may result from decreased light intensity in the z-direction of a substrate. In accordance with the Beer-Lambert Law, logarithmic dependence exists between the transmission, T, of light through a substance and the product of the absorption coefficient of the substance, $\alpha$, and the distance the light travels through the material (i.e., the path length), l. For liquids, transmission of light is defined as:

$$T = \frac{I}{I_0} = 10^{-\alpha l} = 10^{-\varepsilon l c},$$

wherein $\epsilon$ is a molar absorptivity (i.e., extinction coefficient) of the absorber, c is the concentration of absorbing species in the material, $I_0$ and I are the intensity or power of the incident light and the transmitted light, Free radical polymerization induces shrinkage when C=C bonds react with each other to form a polymer. Ink or coating compositions proximal to the radiation source typically shrink more than compositions located distal to the radiation source due to absorption diffusion and diffraction characteristics of radiation. In addition, monomers of the composition in contact with the top surface of the substrate are more likely to react with radicals from the substrate surface layers already chained to the cured surface layers than to react with radicals from the bottom surface of the substrate with a smaller concentration of radicals. Thus, non-uniform polymerization causes the coating or ink compositions to shrink from the edges toward the center of the substrate as well as from the bottom, non-applied composition surface towards the applied composition surface. Therefore, it is common to observe a thick layer of ink or coating warp after curing as shown in FIG. 1. Accordingly, these layers are prone to popping off and/or becoming separable from the substrate.

In the past decade or so, there has been an increased demand by manufacturers to improve adhesion characteristics between applied coating or ink compositions and substrates with high glass transition temperatures, $T_g$, high crystalline densities and/or high tensile strengths. This is primarily attributed to the tendency of cured composition layers to pop off the substrate. Primer or chemically treated layer or layers applied onto a substrates in order to lower the substrate's $T_g$ and/or crystalline density. While adhesion properties may be improved, a significant increase in material cost is expected. Moreover, additional processing steps and equipment would be required.

Adhesion promoters also have been used to improve adhesion characteristics. However, adhesion promoters pose similar burdens as discussed above for primer layers or chemically treated layers. In addition, adhesion promoters are not user-friendly and may possibly lead to skin and eye irritations. Adhesion promoters also are prone to migration and therefore result in toxicity issues. Moreover, adhesion promoters include lower functional monomers and are less likely to be locked into the polymer backbone, especially near the bottom of the ink layer where radiation intensity is significantly weaker than at the surface of the ink layer. This affects curing speed.

A need therefore exists in the art for improving adhesion performance of coating and ink compositions applied on substrates with high $T_g$ or high crystalline density (high tensile strength).

A need also exists for improving the curing speed of ink and coating compositions applied on substrates.

A need further exists for a product with improved adhesion and/or cure properties.

SUMMARY OF THE INVENTION

It has surprisingly been found by the inventors that two-sides (i.e., two surface) radiation exposure significantly improves adhesion performance of coating or ink compositions applied onto nonporous substrates. Specifically, curing characteristics and the shrinkage direction of the composition are manipulated to produce more uniform cross-linking of monomers through the depth of the applied and cured composition.

One advantage of the present invention is a cost-friendly method of radiation exposing a coating or ink composition applied on a nonporous substrate with improved adhesion.

Another exemplary advantage of the present invention is a radiation exposed coating or ink composition applied on a nonporous substrate with improved cure speed (i.e., throughput).

A further, exemplary advantage of the present invention is an environmentally-friendly radiation exposed coating or ink composition applied on a substrate.

An even further exemplary advantage of the present invention is the reduction or elimination of deformed coating or ink compositions applied on nonporous substrates via the two-sided radiation exposure technique.

The present invention describes a method for improving adhesion characteristics and/or curing speeds of an applied coating or ink composition on a nonporous substrate exposed to radiation both from an applied composition surface and a non-applied composition surface of the substrate. In another exemplary embodiment, a method for applying a coating or ink composition on a nonporous, transparent or semi-transparent substrate exposed to radiation both from an applied composition surface and non-applied composition surface of the substrate is described. In a further embodiment, a method for applying a coating or ink composition on a nonporous, unprimed or non-chemically treated substrate exposed to radiation both from an applied composition surface an printed and a non-applied composition surface of the substrate is described. In yet even a further embodiment, there is described a method for applying a coating or ink composition on a nonporous, transparent or semi-transparent, non-chemically treated or unprimed substrate exposed to radiation both from an applied composition surface and a non-applied composition surface of the substrate is described.

In the above-described embodiments, a top side or surface of a substrate with a coating or ink composition applied thereon is exposed to radiation from a radiation source one or more times, in addition to a bottom surface of the substrate that is exposed to radiation from a radiation source one or more times. The two-sided radiation exposure method of a coating or ink composition applied on a substrate improves adhesion and curing characteristics.

In a further, exemplary embodiment of the present invention, there is described a radiation exposed, porous substrate with a coating or ink composition applied thereon produced by the steps of applying a coating onto a first surface of the substrate, exposing the applied first surface of the substrate to radiation one or more times, and exposing a second, non-applied surface of the substrate to radiation one or more time. In yet a further exemplary embodiment, the substrate is both porous and non-chemically treated or unprimed. In even a further exemplary embodiment, the substrate is both porous and transparent or semi-transparent. In another, further exemplary embodiment, the substrate is porous, non-chemically treated or unprimed, and transparent or semi-transparent.

Various setups for applying radiation from a radiation source to the substrate are possible. In a preferred embodiment, radiation originates from a radiation source and is applied to a bottom surface before radiation that originates from another radiation source and is applied to the top surface of the substrate having ink applied thereon. Repetition of radiation exposure from a radiation source, either from the top or bottom sides of the substrate, may be optimized to achieve good adhesion and/or curing characteristics.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the Drawings.

DETAILED DESCRIPTION OF THE ILLUSTRATED EMBODIMENTS

Figure 1:
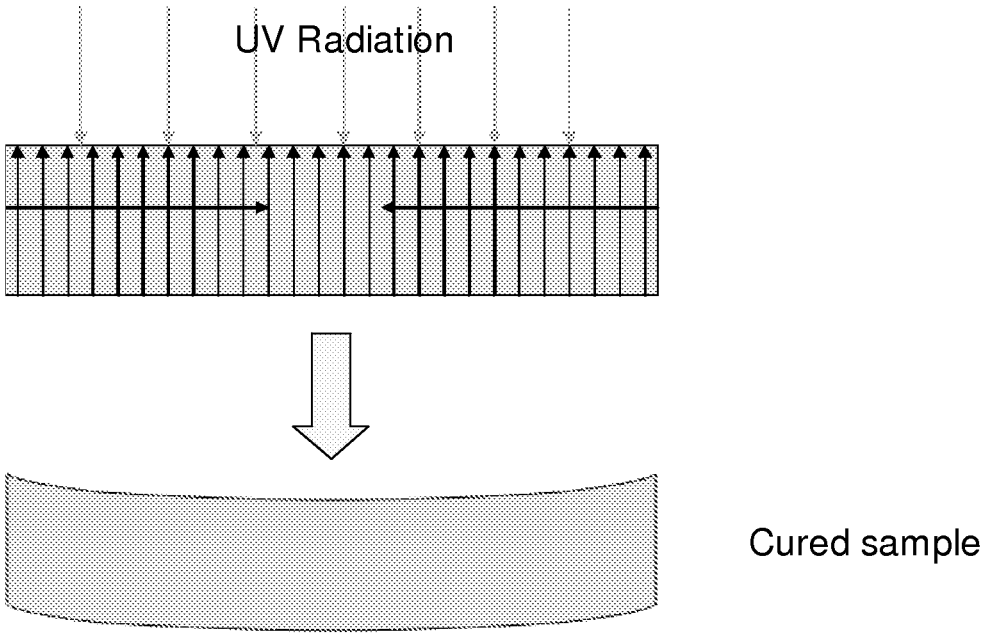
FIG. 1 illustrates the extent of warping during one-sided curing.

Reference will now be made in detail to the embodiments of the present invention, and examples of which are illustrated in the accompanying drawings.

The inventors of the present invention have discovered that two-sided radiation exposure to coating or ink compositions applied on substrates exhibits improved uniform cross-linking through the depth of the composition. In turn, the novel curing technique improves adhesion and/or cure characteristics. In an exemplary embodiment, coating or ink compositions are radiated both from a top and a bottom side or surface of a nonporous substrate. In another exemplary embodiment, coating or ink compositions which are radiated both from a top and a bottom side or surface of a nonporous, unprimed or non-chemically treated substrate (i.e., uncoated) exhibits improved adhesion. In a further exemplary embodiment, coating or ink compositions which are radiated both from a top and a bottom side or surface of a nonporous, transparent or semi-transparent substrate exhibits improved adhesion. In yet even a further exemplary embodiment, coating or ink compositions which are radiated both from a top and a bottom side or surface of a nonporous, non-chemically treated or unprimed, transparent or semi-transparent substrate exhibits improved adhesion.

It is believed by the inventors that the two-sided radiation exposure technique of the inventors eliminates the need for applying primed or chemically treated layers on the substrate which are commonly used to improve adhesion of coating or ink compositions printed onto a substrate. By so doing, additional material costs can dramatically be reduced and/or eliminated. In addition, shrinkage and/or migration of the composition can be reduced upon cure. It is also understood by the inventors that the instant two-sided radiation exposure technique allows for little, if any, adhesion promoters to aide in improving the adhesion characteristics of the composition applied on unprimed or non-chemically treated substrates.

However, when the novel radiation exposure technique was used to apply compositions on primed or chemically treated substrates, at least comparable or improved adhesion results were exhibited in relation to the adhesion results obtained when conducting experimentation on unprimed or non-chemically treated substrates. One of the conceived advantages of using the inventive method on ink or coating compositions applied onto primed or chemically treated substrates is increased curing speed (i.e., throughput).

In an exemplary embodiment, the two-sided radiation exposure process is performed on porous substrates with a suitable coating or ink composition printed thereon. The suitable composition may be energy curable. Alternatively, the composition may be non-energy curable. In yet a further exemplary embodiment, energy curable compositions containing inert resins or lower functionality monomers/oligomers are applied to substrates. Such additives in an energy-curable composition are understood by the inventors to reduce shrinkage during polymerization. This is critical to reduce or prevent the cured layer from popping-off substrates with high tensile strengths and high crystalline densities.

According to the invention, radiation may be applied to either the applied or non-applied surface of the substrate one or more times. The frequency and pattern of radiation exposure to the substrate surfaces may be optimized in accordance with the type of substrate. Optimization also depends upon the type of coating or ink composition. Optimization may also depend upon curing speed and temperature conditions. Optimization may also depend upon the substrate, coating or ink composition, and curing conditions, individually or in combination with one another.

In another exemplary embodiment, an applied or non-applied composition on a surface of a substrate may simultaneously be applied to radiation. The radiation source may be of a different type. Alternatively, the radiation source may be of the same type.

In yet a further embodiment, exposing the non-applied surface to radiation from a radiation source before exposing the applied ink or coating composition surface to radiation from a radiation source has been found to exhibit better adhesion characteristics than if the printed composition surface is first exposed to radiation from a radiation source. It is believed by the inventors that radiation curing first from the non-applied surface of the substrate causes the first layer of monomers in contact with the substrate to cure first. Hence, there is no force pulling these monomers away from the substrate. In addition, free monomers on the applied composition surface of the substrate are more likely drawn to the bottom of the composition film instead of being pulled away.

In yet a further embodiment, curing speeds are considerably improved when a bottom-first, two-sided radiation method is performed on a transparent or semitransparent substrate with an ink or coating composition applied thereon.

Figure 7:
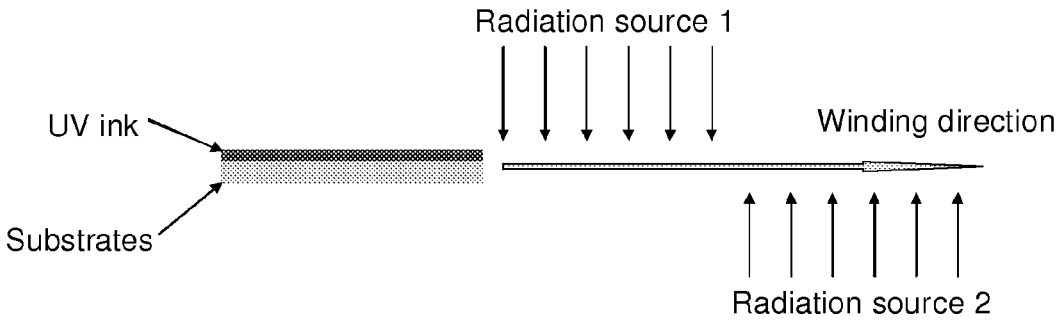
FIG. 7 illustrates two-sided curing wherein the applied ink composition surface of a substrate is cured first by a radiation source and the applied ink composition surface is cured second by another radiation source.
Figure 8:
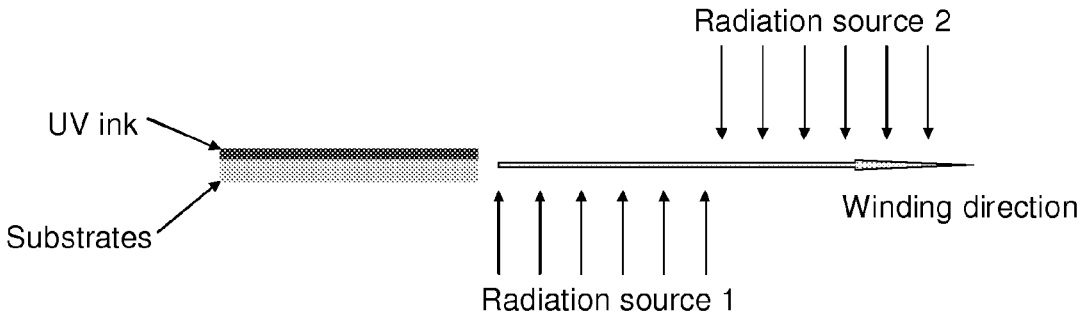
FIG. 8 illustrates two-sided curing wherein the applied ink composition surface of a substrate is cured by a radiation source followed by curing of the applied ink surface by another radiation source.
Figure 9:
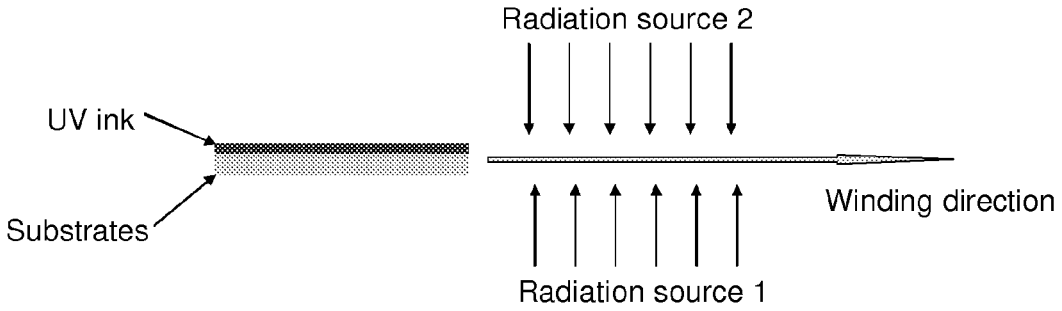
FIG. 9 illustrates two-sided curing in which the applied and non-applied surfaces of the substrate simultaneously are cured by plural radiation sources.

As mentioned above, there are many possible configurations and variations for the two-sided curing method. The three most preferred configurations are discussed in further detail below. As shown in FIG. 7, the substrate with an ink printed on a surface thereon passes through a first curing station. The printed composition surface is exposed to radiation first. Then the substrate passes through a second curing station, exposing the non-printed surface of the substrate to radiation. As shown in FIG. 8, the substrate with an ink printed on a surface thereon passes through a first curing station. The non-printed surface is exposed to radiation first. Then the substrate passes through a second curing station, exposing the printed ink surface. As shown in FIG. 9, the substrate with an ink printed on a surface thereon simultaneously passes through two curing stations. The first curing station exposes the printed ink surface to radiation and the second curing station exposes the non-printed surface to radiation. As will be explained in detail below, each of the above-mentioned two-sided curing techniques exhibits improved adhesion over single-sided radiation exposure.

The frequency (i.e., number of repetitions) of radiation exposure from a radiation source to each surface of the substrate, in addition to the radiation-curing pattern, can be optimized as long as both surfaces of the substrate are exposed to radiation at least once. One factor which may affect the repetition and pattern of curing the applied coating or ink composition on the substrate may include opacity and color of the composition. Another factor may include composition film thickness. Another factor may include the substrate type, quality and texture. Yet another factor may include the number and type of radiation sources used for curing the printed and non-printed ink surfaces. Another factor may include the power (i.e., wattage) of each radiation sources used in the two-sided curing technique.

In one embodiment, the frequency of radiation curing and pattern includes exposing both the non-applied surface and the applied surface to radiation twice, as long as the non-applied surface is exposed to radiation at least once before exposing the applied composition surface to radiation. In another embodiment, the non-applied surface is exposed to radiation three times and the applied surface is exposed to radiation two times, as long as the non-applied surface is exposed at least once before exposing the applied surface to radiation. In yet a further embodiment, the non-applied surface is exposed to radiation three times and the applied surface is exposed to radiation one time, as long as the non-applied surface is exposed at least once before exposing the applied surface to radiation.

Any type of radiation may be used in the present invention. The type of radiation may depend upon the substrate and coating or ink composition used in the two-sided curing method. In this invention, radiation may be Actinic. Particularly, actinic radiation may include ultraviolet radiation provided for example by LEDs or mercury lamps. Actinic radiation may also include electron beam radiation (EB). Actinic radiation may otherwise include cationic polymerization. Actinic radiation may also include visual light. Actinic radiation may also include infrared. Actinic radiation may also include laser radiation. Actinic radiation may also include microwave radiation. Further, actinic radiation may also include ionization radiation.

In a further embodiment, while plural radiation sources can be used, the type of radiation may be the same. Alternatively, while plural radiation sources may be used, the type of radiation may be different. In an exemplary configuration, the applied ink or coating composition surface of the substrate is radiated by UV and the non-applied surface is radiated by LED. Alternatively, the applied composition surface is radiated by LED and the non-applied surface is radiated by UV. In another embodiment, the non-applied surface is radiated once by UV and once by LED, in any order, and the applied composition surface is radiated once by UV. In yet another embodiment, the non-applied surface is radiated once by UV and once by LED, in any order, and the applied composition surface is radiated once by LED.

Figure 5:
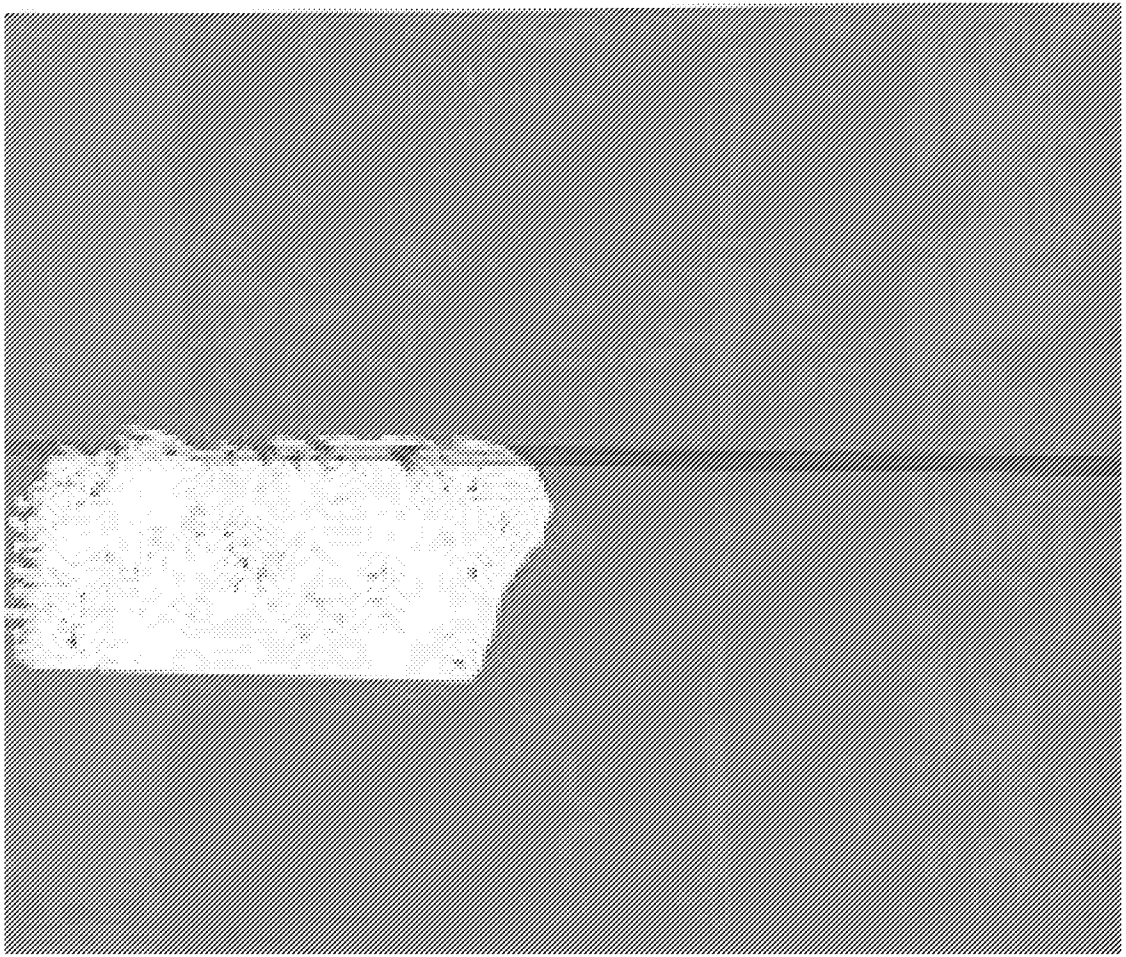
FIG. 5 illustrates adhesion characteristics of an applied ink film on an uncoated, oriented polypropylene (OPP) substrate comparing two-sided curing with exposure first to the non-applied surface followed by exposure to the applied ink surface versus exposure first to the applied ink surface followed by exposure to the non-applied surface.

Increasing the number of radiation sources, such as UV or LED lamps, from either the applied composition surface or the non-applied surface may help improve adhesion and/or cure at higher line speeds. More lamps may also be used to help compensate for low lamp output or faster curing speeds. In another, exemplary embodiment, improved adhesion may directly affect throughput by allowing for a faster line speed. In a further, exemplary embodiment, improved cure characteristics also affects throughput by allowing for faster line speeds of the radiation source. For example, FIG. 5 illustrates samples of a commercial ink applied on a non-primed or non-chemically treated substrate of oriented polypropylene (OPP), radiated at 300 FPM using mercury UV lamps at 300 watts. The left hand side of the sample was radiated first from the non-applied surface of the substrate followed by the applied ink surface of the substrate. On the other hand, the right hand side of the sample was radiated first from the applied ink surface of the substrate proceeded by the non-applied surface. As shown, almost none of the left hand side had its coating removed from the substrate after a standard peel test, whereas the right hand side had an overwhelming amount of its coating peel off during a standard peel test. The left hand side also exhibited an improved curing conversion or degree over the right hand side withstanding almost twice as many MEK double rubs.

Customers in the packaging industry, especially relating to plastics, are eager to develop good adhesion characteristics between substrates and ink films. Since all substrates do not have the same properties, adhesion may vary tremendously depending upon the shrinkage of coating or ink printed thereon. Accordingly, selecting an appropriate coating or ink formula is an important parameter in obtaining improved adhesion and reduced shrinkage of the final, cured product.

Some important characteristics of the substrate are Machine Direction of modulus(Pa) and/or Melting temperature. Machine direction of modulus describes the relationship of how easily the substrate film can be stretched. Some common plastic substrates used in the packaging industry are bi-axially oriented polypropylene (BOPP), low-density polyethylene (LDPE), medium density polyethylene (MDPE), high density polyethylene (HDPE), polyethylene phthalate (PET), polyethylene phthalate glycol (PETG), and polyvinyl chloride (PVC). Table 1 lists general tensile strengths and melting temperatures for some of the above-mentioned substrate materials.

TABLE 1

| | BOPP | LDPE | HDPE | PET |
|---|---|---|---|---|
| Tensile Strength (MPa) | 19-42 | 9-15 | 23-25 | 47-90 |
| Melting temperature (° C.) | 130-170 | 108-114 | 131-135 | 200-255 |

Many different ink compositions can be used in the present invention. In particular, the following inks manufactured by Sun Chemical were used in the experiments discussed in this disclosure: FLNFV5482107, FLNFV1482594, FLTSV9483557: Starluxe intense black. In addition, an experimental ink called R3590-113-1 was used. Table 2 describes the composition of each of these inks.

As shown in Table 2, each of these inks contain multifunctional monomers. R3590-113-1 however does not contain contain oligomers and includes one or more thermoplastic acrylic inert resins instead.

TABLE 2

| | | |
|---|---|---|
| FLNFV5482107 | | |
| multifunctional acrylate monomer and oligomers | builds backbone of cured ink film | 40-70% |
| Pigment | | 12-30% |
| Additives | can include, but is not limited to pigment dispersants, rheology modifiers, defoamers, inhibitors, etc | 1-5% |
| Photo Initiator Compound | | 5-15% |
| R3590-113-1 | | |
| thermoplastic acrylic inert resin(might be the reason for better adhesion on BOPP film) | | 15.5-20% |
| multifunctional acrylate monomer | | 16.5-30% |
| monofunctional monomer | | 8.55-15% |
| Additives | | 5.65-15% |
| Pigment | | 52.40-60% |
| photoinitiator compound | | 7.55-12% |
| FLNFV1482594 | | |
| multifunctional acrylate monomer and oligomer | | 10-40% |
| monofunctional monomers | | 10-20% |
| Additives | | 1-3% |
| Pigment | | 40-60% |
| photoinitiator compound | | 5-12% |
| FLTSV9483557:STARLUXE INTENSE BLACK | | |
| aldehydes resin solution | | 25-40% |
| multifunctional acrylate monomer and oligomer | | 15-30% |
| Additives | | 2-7% |
| Pigment | | 15-25% |
| photoinitiator compound | | 10-20% |

Adhesion Test

According to the invention, a standard peel test was used to quantify adhesion characteristics of the coating or ink on the substrate. Specifically, 3M 600 Scotch Transparent Tape was firmly adhered across the surface of the sample immediately after radiation exposure. The tape was rapidly removed using manual force applied perpendicular to the surface of the sample. The sample was visually examined for detachment of flakes. Generally, the appearance of the sample is classified on a 0-3 scale, with 0 (no ink removal) being the best, and 5 (complete ink removal) being the worst. Adhesion of the sample can also be quantified numerically by determining the surface area of the sample that showed detachment of flakes in relation to the area of the sample that did not show detachment of flakes.

MEK Rub Test

This test method is used to determine the degree of cure of according to ASTM D4756. The test involves rubbing the surface of a cured film with a cheesecloth or cotton pad soaked with MEK until failure or breakthrough of the film. The type of cheesecloth, the stroke distance, the stroke rate, and approximate applied pressure of the rub are specified in the protocol and incorporated in its entirety by reference. The rubs are counted as a double rub (one rub forward and one rub backward constitutes a double rub).

Extractable Test

Extractable tests were performed on the non-food contact side (non-printed ink side) of the substrate using a fatty food simulant in accordance with the following test method.

All samples were analyzed in duplicate by non-food contact side migration tests. Stainless steel migration cells were used to analyze the samples. The surface area analyzed for each sample was 51 $cm^2$ and the extraction volume was 30 ml. The food simulant liquid (FSL) used was a fatty food simulant composed of 95% ethanol and 5% water. The solvent volume to surface area ratio was 0.59 $ml/cm^2$ (3.8 $ml/in^2$). This is more concentrated than the FDA guidelines of 10 $ml/in^2$, allowing for a lower detection limit.

The printed samples were immersed in the FSL and subjected to an extraction period of 24 hours at 40° C. After the extraction period, the prints were removed from the FSL and analyzed for dissolved (extracted) components as follows: the 30 ml (FSL) extracts were spiked with 100 ppb of the internal standard $d_{10}$ anthracene and then concentrated to approximately 1.0 ml using a gentle stream of nitrogen at 75° C. The concentrated extracts were diluted with 5.0 ml of methylene chloride then further concentrated to approximately 1.0 ml using a gentle stream of nitrogen at room temperature. The concentrated extracts were analyzed by gas chromatography and/or mass spectrometry.

The present invention has been described in detail, including the preferred embodiments thereof. However, it will be appreciated that those skilled in the art, upon consideration of the present disclosure, may make modifications and/or improvements on this invention that fall within the scope and spirit of the invention.

Results and Discussion

The following examples illustrate specific aspects of the present invention and are not intended to limit the scope thereof in any respect and should not be so construed.

EXAMPLE 1

Figure 2:
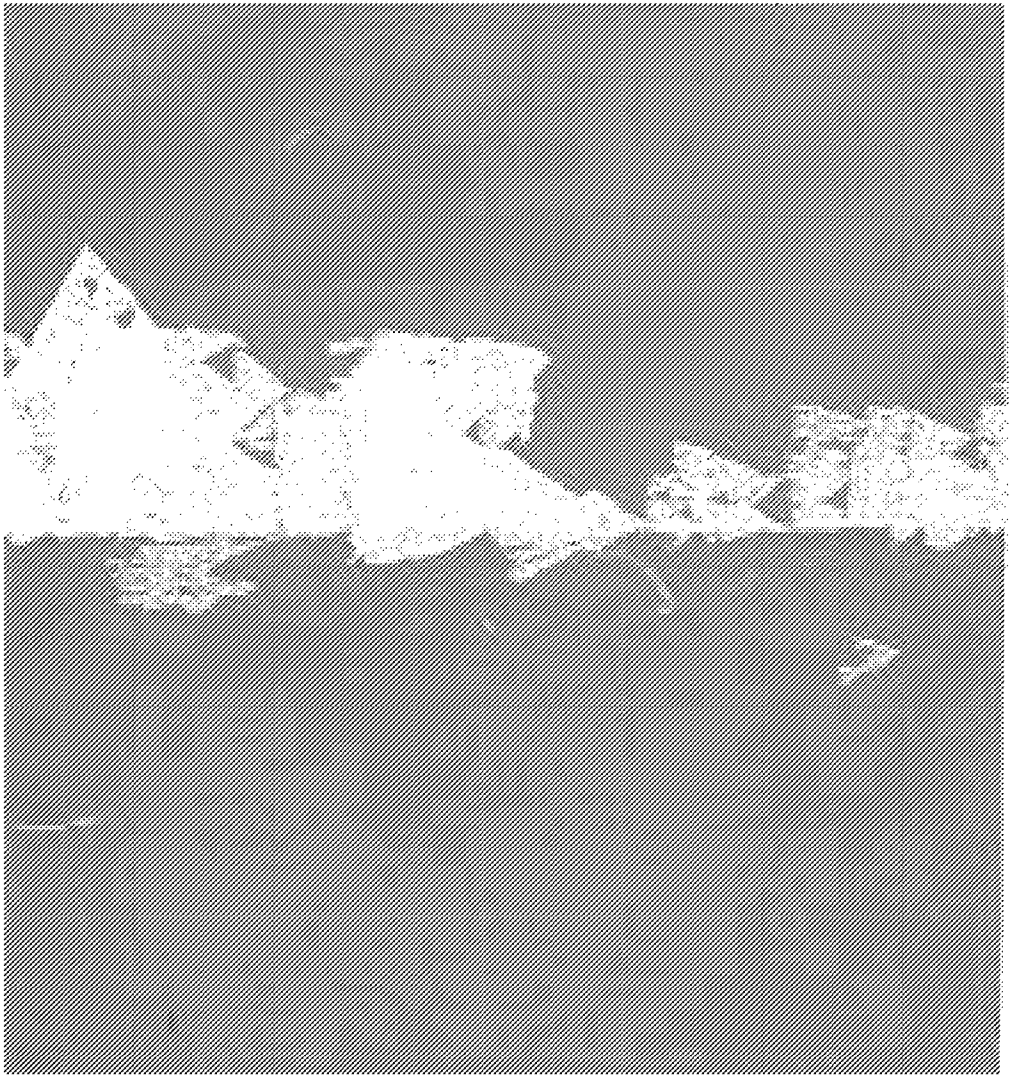
FIG. 2 illustrates adhesion characteristics of an applied ink film on an uncoated, oriented polypropylene (OPP) substrate that is subjected to single-sided cure versus an applied ink film that is subjected to two-sided cure wherein the applied ink surface is exposed first to radiation followed by exposing the non-applied surface to radiation.

As illustrated in FIG. 2 and described in Table 3 below, a commercial UV flexo ink, MaxD cyan from Sun Chemical (i.e., FLNFV5482107), was applied using an 800 line, 1.89 bcm analox on an uncoated OPP film and cured using a 300-watt mercury lamp at medium power at 200 FPM.

With the right side of the print covered to prevent any exposure to UV light, the left side of the print was exposed twice to the UV lamp from the printed ink surface. Subsequently, the left side of the print was covered on both sides to prevent any exposure to UV light while the right side of the print was exposed first from the printed ink surface, then from the non-printed ink surface through the substrate. Immediately after exposures, an adhesion test was performed using 3M 600 tape. As shown in FIG. 2, the ink radiated on two sides exhibited significantly better adhesion than the ink radiated only from the printed ink surface. For example, the right hand side exhibited less than 5% of its coating peel off when the standard peel test as described above was performed. The left hand side had about 95% of its coating peel off when the standard peel test was performed.

The left hand side withstood 5 MEK double rubs and the right hand side withstood 10 MEK double rubs. Hence, two-sided curing exhibits curing speeds twice as fast as single sided curing.

EXAMPLE 2

Figure 3:
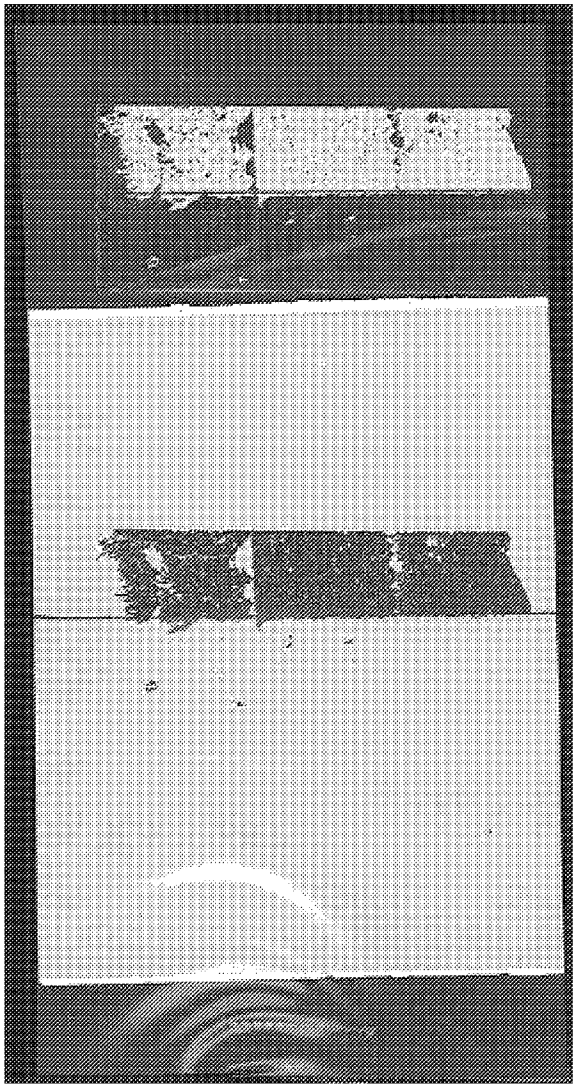
FIG. 3 illustrates adhesion characteristics of an applied ink film on an uncoated, high-density polyethylene (HDPE) substrate that is subjected to single-sided cure versus an applied ink film that is subjected to two-sided cure wherein the applied ink surface is exposed first to radiation followed by exposing the non-applied surface to radiation.

As illustrated in FIG. 3 and described in Table 3 below, a commercial UV flexo ink, MaxD white from Sun Chemical (i.e., FLNFV1482594), was applied using a 360 line, 4.14 bcm analox on uncoated HDPE film and cured using a 300-watt mercury lamp at medium power at 250 FPM.

With the right side of the print covered to prevent any exposure to UV light, the left side of the print was exposed twice to the UV lamp from the printed ink surface. Subsequently, the left side of the print was covered to prevent any exposure to UV light, and the right side was exposed to the UV lamp from the printed ink surface and then from the non-printed ink surface through the substrate. Immediately after exposures, an adhesion test was performed using 600 tape.

As shown in FIG. 3, the ink radiated on two sides exhibited significantly better adhesion than the ink radiated only from the printed ink surface. For example, the right hand side exhibited less than 1% of its coating peel off when the standard peel test as described above was performed. The left hand side had about 95% of its coating peel off when the standard peel test was performed.

The left hand side withstood more than 100 MEK double rubs and the right hand side also withstood more than 100 MEK double rubs.

EXAMPLE 3

Figure 4:
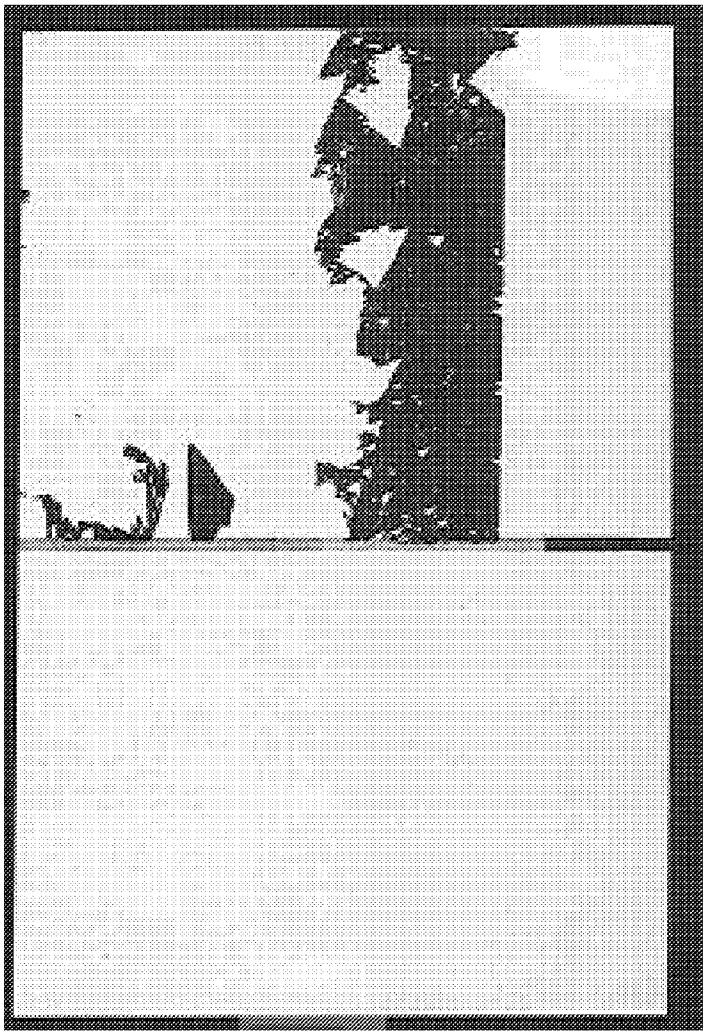
FIG. 4 illustrates adhesion characteristics of an applied ink film on an uncoated, bi-axially oriented polypropylene (BOPP) substrate that is subjected to single-sided cure versus an applied ink film that is subjected to two-sided cure wherein the first exposure is from the top surface and the second exposure is from the bottom surface.

As illustrated in FIG. 4 and described in Table 3 below, an experimental UV flexo white ink (i.e., R3590-113-1), composed of an acrylic resin, di-functional and tri-functional acrylate monomers, TiO2, pigment dispersant, UV initiator compound, and inhibitor, was applied using a 360 line, 4.14 bcm analox on uncoated BOPP film and cured using a 300-watt mercury lamp at medium power at 250 FPM.

With the right side of the print covered to prevent any exposure to UV light, the left side of the print was exposed twice to the UV lamp from printed ink surface. Subsequently, the left side of the print was covered to prevent any exposure to UV light, and the right side was exposed to the UV lamp from the printed ink surface and then from the non-printed ink surface through the substrate. Immediately after exposure, an adhesion test was performed using 600 tape.

As shown in FIG. 4, the ink radiated on two sides exhibited significantly better adhesion than the ink radiated only from the printed surface. For example, the right hand side exhibited almost no peel off when the standard peel test as described above was performed The left hand side had about 90% of its coating peel off when the standard peel test was performed.

The left hand side withstood more than 100 MEK double rubs and the right hand side also withstood more than 100 MEK double rubs.

EXAMPLE 4

As illustrated in FIG. 5 and described in Table 3 below, The same commercial ink used in Example 1 (i.e., MaxD cyan—FLNFV5482107), was applied using an 800 line, 1.89 bcm analox on an uncoated OPP film and cured using a 300-watt mercury lamp at medium power at 300 FPM.

In this Example, both the left and right sides of the print were subjected to two-sided exposure from both the printed ink surface and the non-printed ink surface. The critical difference is that the left side was exposed first from the non-printed surface of the substrate, and then exposed from the printed ink surface. The right side was exposed in the reverse order. First from the printed ink surface, and then from the non-printed ink surface. FIG. 5 shows that the ink exposed from the non-printed ink surface first achieved better adhesion via tape test above-mentioned in addition to faster cure according to the above-mentioned MEK double rub test. For example, almost no coating peeled off when the non-printed ink surface was exposed to radiation first. By contrast, almost all of the coating peeling off when the printed ink surface was exposed to radiation first. With respect to curing speed, curing first from the non-printed ink surface exhibited an MEK result of 15 whereas curing first from the printed ink surface exhibited an MEK result of 7. Hence, curing from the non-printed ink surface first exhibits a curing speed almost twice as fast as when curing first from the printed ink surface in a two-sided curing technique according to the present invention.

In addition, the ink that was exposed first from the printed ink surface, lost adhesion at a faster speed (300 FPM) when compared to the results in Example 1 at a line speed of 200 FPM. As mentioned above, however, ink that was exposed from the non-printed ink surface maintained good adhesion even at line speeds of 300 FPM.

EXAMPLE 5

As shown in and FIG. 6 and described in Table 3 below, a commercial UV litho ink, Starluxe black from Sun Chemical (i.e., FLTSV9483557), was applied using a Little Joe proofing press on uncoated OPP film and cured using a 300-watt mercury lamp at 300 FPM.

With the left side of the print covered to prevent any exposure to UV light, the right side of the print was exposed twice to the UV lamp from the printed ink surface. Subsequently, the right side of the print was covered to prevent any exposure to UV light, and the left side was exposed to the UV lamp from the printed ink surface and then from the non-non-printed ink surface. Immediately after exposures, an adhesion test was performed using 600 tape. The result, exhibited in FIG. 6, shows that the ink with two-sided curing has much improved adhesion than the ink with single-sided curing.

Figure 6:
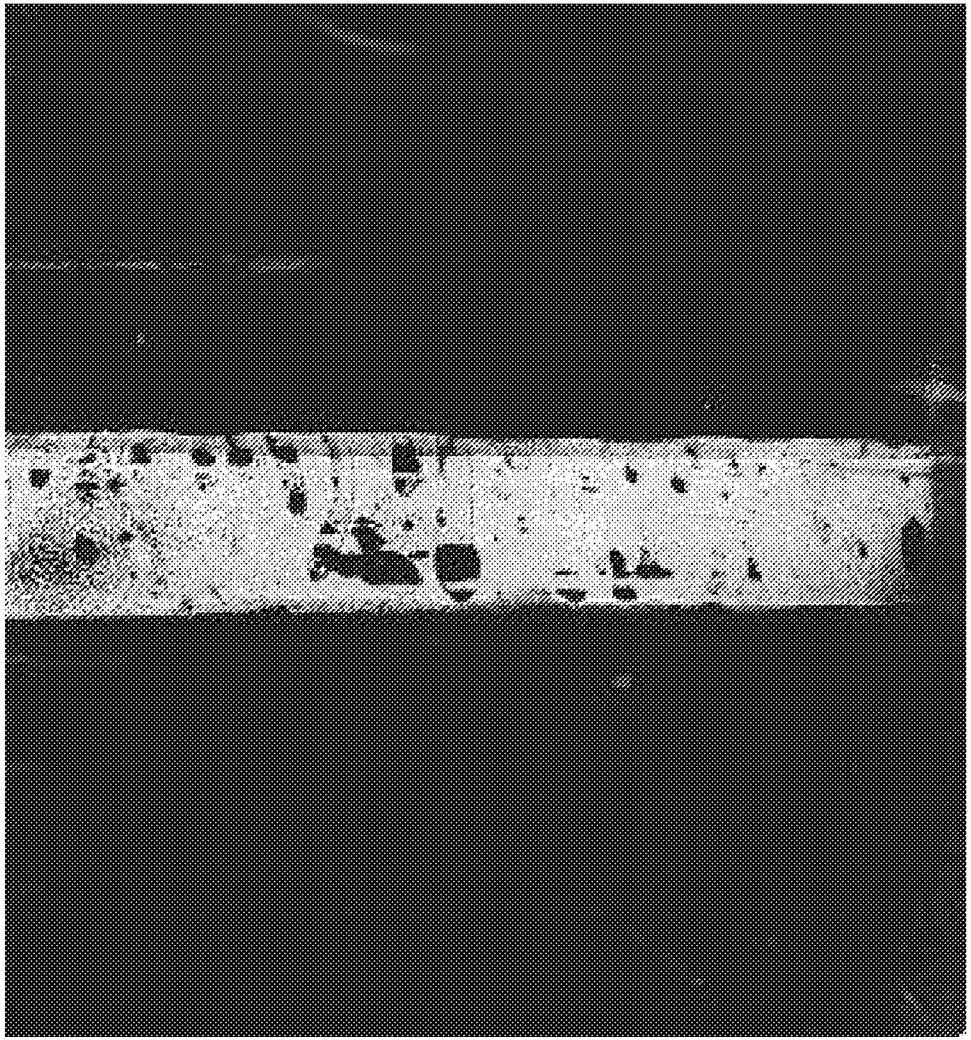
FIG. 6 illustrates adhesion characteristics of an applied black ink film on an uncoated OPP substrate comparing single-sided cure versus two-sided cure with exposure first from the applied ink surface followed by exposure to the non-applied surface.

As shown in FIG. 6, the ink radiated on two sides exhibited significantly better adhesion than the ink radiated only from the printed ink surface. For example, the left hand side exhibited almost no peel off (i.e., less than 1%) when the standard peel test as described above was performed. The right hand side exhibited about 95% of its coating peel off when the standard peel test was performed.

Example 5 is representative that the two-sided curing method can be used to improve the adhesion of opaque, dark, energy curable inks (in this case opaque black ink), which are notoriously prone to cure and adhesion problems due to their strong tendency to absorb radiation.

The inks used in the preceding Examples are blue, black, and white pigmented inks, but it is understood that the two-sided curing method could be used on any colored inks containing virtually any pigment or dye or combination thereof, or even on non-pigmented (non-colored) coatings. In a preferred embodiment, the improved cure and adhesion results seen with two-sided curing method could facilitate the use of more opaque inks than are normally seen in the printing and curing of energy curable inks. One particular color that would benefit from the two-sided curing process would be black inks, especially opaque black inks, which are notoriously difficult to cure uniformly through the depth due to strong absorption of radiation.

The examples in the present application were prepared using lab hand proofing, Little Joe proofing press, or screen printing processes for the purposes of expediency and for testing purposes only. It is understood that the two-sided cure method would be applicable to prints prepared by any traditional print process such as lithographic, flexographic, screen, inkjet, aerosol jet, gravure, digital, letterpress, dry offset, etc.

The MEK rub result tests as illustrated in FIGS. 2 and 3 demonstrate that cure and adhesion are distinct and independent phenomenon as the two-sided curing method provides improved adhesion (as measured with standard adhesion tape test) even in cases where cure (measured by MEK rubs) is equal. In addition, all of the prints disclosed in Examples 1-5 passed the industry standard thumb twist test, a traditional method used in the UV ink industry to test if and ink film is properly cured. This further illustrates that the two-sided curing method improves the adhesion of inks that are adequately cured.

The two-sided curing process is not limited to instances where the ink already exhibits acceptable adhesion and cure using one-sided curing. In these cases, the two-sided curing process could be used to provide improved immediate and long-term adhesion and cure as well as improved immediate and long term chemical and mechanical resistance properties.

TABLE 3

| Examples | Curing conditions | Tape adhesion result | MEK double rub result |
|---|---|---|---|
| Example 1 | 2 surface exposure | 95% peel off | 5 |
| FLNFV5482107 | 1 surface exposure | Less than 5% peel off | 10 |

TABLE 3-continued

| Examples | Curing conditions | Tape adhesion result | MEK double rub result |
|---|---|---|---|
| UV flexo cyan 200 FPM | followed by 1 bottom exposure | | |
| Example 2 | 2 surface exposure | 95% peel off | >100 |
| FLNFV1482594 | 1 surface exposure | Less than 1% peel off | >100 |
| UV flexo white 250 FPM | followed by 1 bottom exposure | | |
| Example 3 | 2 surface exposure | 90% peel off | >100 |
| R3590-113-1 | surface exposure | 0% peel off | >100 |
| UV flexo white Experimental ink 250 FPM | followed by 1 bottom exposure | | |
| Example 4 | 1 bottom exposure | 100% retain | 15 |
| FLNFV5482107 | followed by 1 surface exposure | | |
| UV flexo cyan 300 FPM | 1 surface exposure followed by 1 bottom exposure | 100% peel off | 7 |
| Example 5 | 2 surface exposure | 95% peel off | n/a |
| FLTSV9483557 | 1 surface exposure | <1% peel off | n/a |
| UV flexo black 300 FPM | followed by 1 bottom exposure | | |

EXAMPLE 6

A series of duplicate prints were prepared by screen printing the UV flexo white experimental ink used in above-mentioned Example 3 through 380 mesh onto a corona treated, uncoated BOPP clear film. The duplicate prints were cured using LED lamps in various configurations and line speeds as shown in Table 4.

Phoseon Fireline System high intensity water-cooled LED lamps were used in this example. The LED lamps' specifications were as follows:

Irradiance: 8 W/cm2

Total UV Power: up to 360 W

Peak irradiance: up to 72 W/cm2

UV Output: 380-420 nm

TABLE 4

| | Example | | | | | | | | | | | |
|---|---|---|---|---|---|---|---|---|---|---|---|---|
| | 6A | | | 6B | | | 6C | | | 6D | | |
| Cure Configuration (in sequence) | 2X top, printed ink surface | | | 1X top, printed ink surface/1X bottom, non-printed ink surface | | | 1X bottom, non-printed ink surface/ 1X top, printed ink surface | | | 2X bottom, non-printed ink surface/ 1X top, printed ink surface | | |
| Line Speed (m/min) | 15 | 35 | 60 | 15 | 35 | 60 | 15 | 35 | 60 | 15 | 35 | 60 |
| Tape Adhesion Results* | 3 | 3 | 3 | 2 | 2 | 2 | 1 | 1-2 | 2 | 1 | 1 | 1 |

Experiments for each of samples 6A-D were performed at lines speeds of 15 m/min, 35 m/min and 60 m/min, respectively. The tape adhesion results were evaluated on as a scale of 1 to 3. Adhesion was performed as similarly described above for each of Examples 1-5. Specifically, 3M 600 Scotch Transparent Tape was firmly adhered across the surface of the sample immediately after radiation exposure. The tape was rapidly removed using manual force applied perpendicular to the surface of the sample.

A value of 3 suggests total ink removal and thus indicates failure according to the tape adhesion test. A value of 2 suggests partial ink removal and also indicates failure according to the adhesion test. A value of 1 suggests very slight or no ink removal and is indicative of a sample that passes the adhesion test. Further, a value ranging between 1 and 2 suggest partial ink removal and indicates marginal failure according to the adhesion test.

The LED lamps used as the source of radiation for the two-sided curing process in samples 6B, 6C and 6D produced prints with improved adhesion versus one-sided curing performed in sample 6A. In sample 6C, for example, the ink film is cured first from the non-printed ink surface and subsequently from the printed ink surface which exhibits improved adhesion compared to samples 6B.

Table 4 also suggests exemplary embodiments wherein the two-sided curing process cures one or both of the non-printed and printed ink surfaces plural times. In sample 6D, for example, the ink film is cured by exposing each of the bottom, non-printed ink surface and the top, printed ink surface twice to radiation. Sample 6D shows improved adhesion results over each of samples 6B and 6C which cures both the printed and non-printed ink surfaces only once.

According to the inventors, it may be necessary to cure either or both surfaces one or more times, in any order, based on various factors including but not limited opacity and color of the ink, the ink film thickness, the specific substrate used, the power of the curing lamps. Some curing techniques may include: non-printed ink surface 2×/printed ink surface 2×; non-printed ink surface 3×/printed ink surface 2×; non-printed ink surface 3×/printed ink surface 1×, etc.

The use of the LED lamps in Example 6 also highlights the fact that the two-sided cure method is not limited to traditional mercury UV curing lamps.

EXAMPLE 7

Two sets of duplicate prints, samples 7A and 7B, were prepared by printing a MaxD cyan using an 800 line, 1.89 bcm analox onto an HDPE film. The printed film was cured using a 300-watt mercury lamp on medium power at a line speed of 150 FPM.

The printed film 7A was cured only from the top, printed ink surface with two separate exposures of UV light. The printed film 7B was cured first from the bottom, non-printed ink surface and subsequently cured from the top, printed ink surface with UV light exposure. The results are provided in Table 5.

TABLE 5

| | Average of Duplicate Cured Prints | | | |
|---|---|---|---|---|
| | 7B | | 7A | |
| Source | ppb | ng/cm$^2$ | ppb | ng/cm$^2$ |
| Ink-Borne Extractable, 95% ETOH | 1,994 | 1,176 | 3,828 | 2,258 |

The concentration of extractable amounts in parts per billion (PPB) for each of samples 7A and 7B was evaluated with 95% ETOH food simulant extraction solvent. As shown in Table 5, 1,176 ng/cm$^2$ and 2,258 ng/cm$^2$ of the surface area of samples 7A and 7B, respectively, were exposed to the extraction solvent.

Specifically, the two-sided curing technique produced cured ink films with lower amounts of extractables, and thus lower migration. The amount of ink-borne extractables from the two-sided curing technique in 7B was about 50% lower the amount of ink-borne extractables from one-sided curing in 7A. The reduction of extractable components in 7B renders the energy curable ink more user-friendly with regard to toxicity and FDA compliance guidelines for direct or non-direct food contact.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for applying a coating or ink composition on a nonporous substrate comprising:

applying said coating or ink composition onto a first surface of said nonporous substrate;

exposing said applied first surface of said nonporous substrate to radiation one or more times; and exposing a second surface of said nonporous substrate to radiation one or more times; wherein said nonporous substrate is an unprimed or non-chemically treated substrate.

2. The method according to claim 1, wherein said applied first surface is exposed to radiation before said second surface.

3. The method according to claim 1, wherein said second surface is exposed to radiation before said applied first surface.

4. The method according to claim 3, wherein said composition has less than 2,000 ppb of extractable monomers from a surface area of 51 cm when immersed in 30 ml of a food simulant liquid after both said first and second surfaces are exposed to actinic radiation.

5. The method according to claim 1, wherein said applied first surface is subject to less aggregate exposure of radiation than said second surface.

6. The method according to claim 1, wherein said nonporous substrate is transparent or semi-transparent.

7. The method according to claim 1, wherein said nonporous substrate is selected from: polypropylene, polyethylene, polyethylene terephthalate, polyethylene terephthalate glycol, polyvinyl chloride or mixtures thereof.

8. The method according to claim 1, wherein said ink composition is an energy-curable ink.

9. The method according to claim 8, wherein said energy-curable ink comprises one or more thermoplastic acrylic inert resins.

10. The method according to claim 1, wherein greater than or equal to about 95% of said coating or ink composition adheres to said substrate after both said first and second are exposed to radiation.

11. The method according to claim 10, wherein greater than or equal to about 99% of said coating or ink composition adheres to said substrate.

12. The method according to claim 11, wherein greater than or equal to about 99.99% of said coating or ink composition adheres to said substrate.

13. A radiation exposed, nonporous substrate with a coating or ink composition applied thereon produced by the steps:

applying said composition onto a first surface of said nonporous substrate;

exposing said applied first surface of said nonporous substrate to radiation one or more times; and exposing a second surface of said nonporous substrate to radiation one or more times; wherein said nonporous substrate is an unprimed or non-chemically treated substrate.

14. The radiation exposed, nonporous substrate according to claim 13, wherein said applied first surface is exposed to radiation before said second surface.

15. The radiation exposed, nonporous substrate according to claim 14, wherein said second surface is exposed to radiation before said applied first surface.

16. The radiation exposed, nonporous substrate according to claim 15, wherein said composition has less than 2,000 ppb of extractable monomers from a surface area of 51 cm when immersed in 30 ml of a food simulant liquid.

17. The radiation exposed, nonporous substrate according to claim 13, wherein said applied first surface is subject to less aggregate exposure of radiation than said second surface.

18. The radiation exposed, nonporous substrate according to claim 13, wherein said nonporous substrate is transparent or semi-transparent.

19. The radiation exposed, nonporous substrate according to claim 13, wherein said nonporous substrate is selected from: polypropylene, polyethylene, polyethylene terephthalate, polyethylene terephthalate glycol, polyvinyl chloride or mixtures thereof.

20. The radiation exposed, nonporous substrate according to claim 13, wherein said composition is an energy-curable ink.

21. The radiation exposed, nonporous substrate according to claim 13, wherein said energy-curable ink comprises one or more thermoplastic acrylic inert resins.

22. The radiation exposed, nonporous substrate according to claim 13, wherein greater than or equal to about 95% of said composition adheres to said substrate after both said first and second surfaces are exposed to radiation.

23. The radiation exposed, nonporous substrate according to claim 22, wherein greater than or equal to about 99% of said composition adheres to said substrate.

24. The radiation exposed, nonporous substrate according to claim 23, wherein greater than or equal to about 99.99% of said composition adheres to said substrate.

25. Packaging materials selected from plastic materials, food-grade materials, cosmetic materials, industrial coating materials and pharmaceutical materials comprising the radiation exposed nonporous substrate according to claim 13.

* * * * *